US005327763A

United States Patent [19]

Kramer et al.

[11] Patent Number: 5,327,763

[45] Date of Patent: Jul. 12, 1994

[54] APPARATUS FOR COOLING EXTRUSION PRESS PROFILE SECTIONS

[75] Inventors: Carl Kramer; Dirk Menzler, both of Aachen, Fed. Rep. of Germany

[73] Assignee: WSP Ingenieurgesellschaft fur Warmetechnik, Aachen, Fed. Rep. of Germany

[21] Appl. No.: 969,826

[22] PCT Filed: Jul. 30, 1991

[86] PCT No.: PCT/EP91/01425

§ 371 Date: Feb. 2, 1993

§ 102(e) Date: Feb. 2, 1993

[87] PCT Pub. No.: WO92/02316

PCT Pub. Date: Feb. 20, 1992

[30] Foreign Application Priority Data

Aug. 2, 1990 [DE] Fed. Rep. of Germany ..... 4024605

[51] Int. Cl.[5] ..... B21C 29/00

[52] U.S. Cl. ..... 72/257; 72/201

[58] Field of Search ..... 72/201, 253.1, 257, 72/342.2; 239/418, 556, 562, 568, 597

[56] References Cited

U.S. PATENT DOCUMENTS

| | | | |
|---|---|---|---|
| 4,210,288 | 7/1980 | Dobson | 239/597 |
| 4,300,376 | 11/1981 | Wilmotte | 72/201 |
| 4,453,321 | 6/1984 | McDonald et al. | 72/257 |
| 4,790,167 | 12/1988 | Gentry et al. | 72/257 |

FOREIGN PATENT DOCUMENTS

| | | |
|---|---|---|
| 8810085 | 8/1988 | European Pat. Off. . |
| 2190540 | 6/1972 | France . |
| 2375911 | 12/1976 | France . |
| 58-157914 | 9/1983 | Japan . |
| 61-231124 | 10/1986 | Japan . |

OTHER PUBLICATIONS 1-317615 dated Mar. 6, 1990, English Abstract Japan.

*Primary Examiner*—Lowell A. Larson
*Attorney, Agent, or Firm*—Adduci, Mastriani, Schaumberg & Schill

[57] ABSTRACT

An apparatus for cooling extruded profile sections comprises nozzles which are arranged above and below an exit path of the extruded profile section and which are formed as air nozzles arranged transversely of the pressing and exit direction of the extruded profile section and having slit-shaped nozzle openings. The air nozzles arranged beneath the exit path have a smaller nozzle slit width than the air nozzles arranged above the exit path and blowing onto the extruded profile section from above; the distance of the lower air nozzles from the extruded profile section is less than the distance of the upper air nozzles from the extruded profile section; and the air nozzles arranged beneath the extruded profile section are offset with respect to the air nozzles arranged above the extruded profile section in each case by half the pitch, measured in the pressing and transport direction of the extruded profile section.

14 Claims, 7 Drawing Sheets

APPARATUS FOR COOLING EXTRUSION PRESS PROFILE SECTIONS

Figure 1:
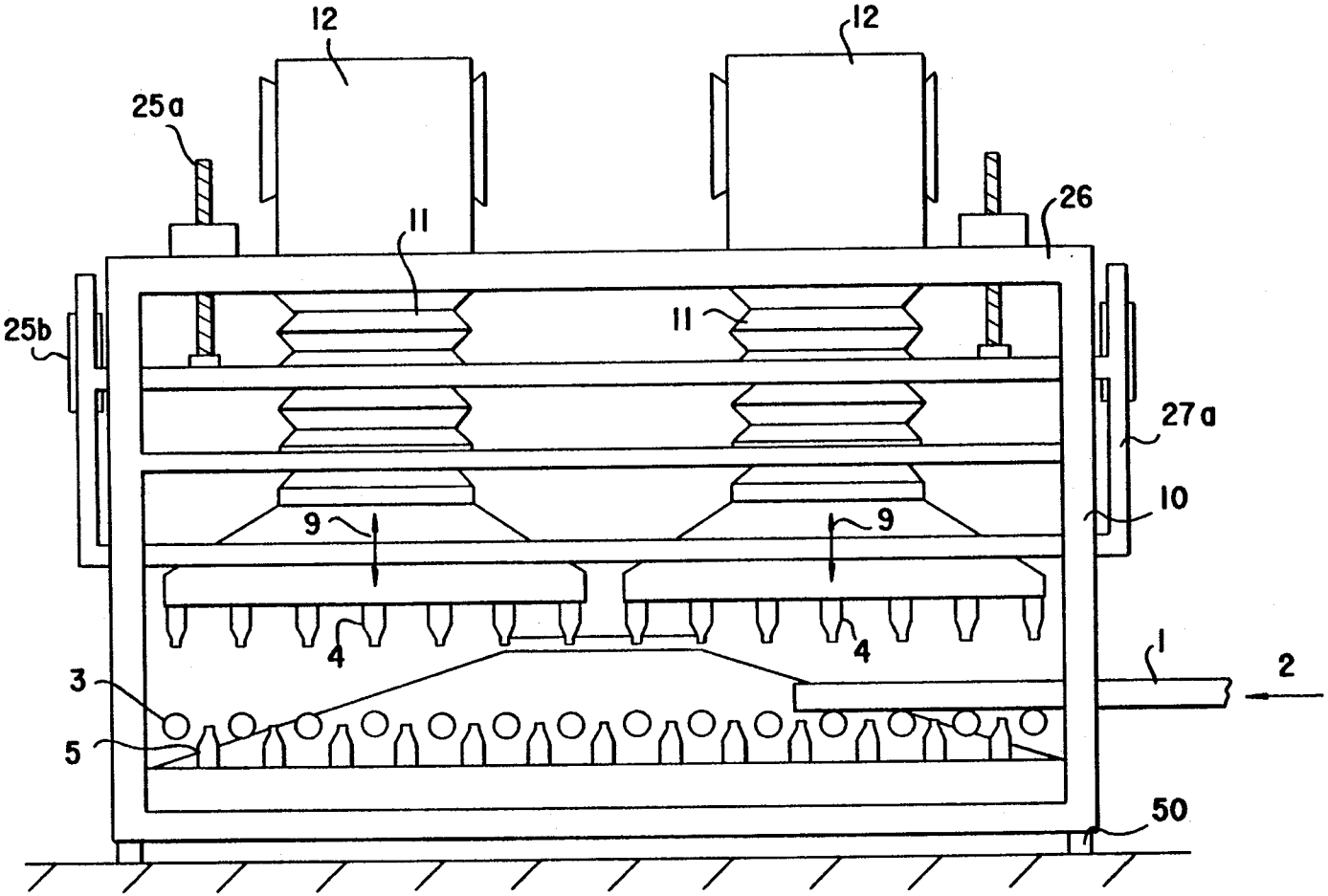

The invention relates to an apparatus for cooling extrusion press profile sections having an upper air nozzle arranged above an exit path of the extruded profile section and having a slit-like nozzle opening, and lower air nozzles arranged beneath the exit path offset in the transport direction with respect to the upper nozzle and at a smaller distance from the extruded profile section than the upper nozzle.

Profile sections made by an extrusion press must be cooled after leaving the press die. This applies in particular to extrusion press profile sections of lightweight metal alloys. The necessary temperature/time gradients lie between 3° and 5° K./s for AlMgSi alloys and up to 50° K./s for high-strength alloys, for example aviation materials.

The necessary high cooling rates can be achieved by drawing the bars or rods through a stationary water wave or by cooling the extrusion press profile sections in so-called "water boxes" having walls provided with spray nozzles. Admittedly, this achieves the necessary cooling rates as regards the metallurgical requirements; however, by the very rapid cooling, which is moreover not uniform over the periphery, the extrusion press profile sections are deformed and as a result high expenditure for subsequent adjustment is frequently necessary. Moreover, with the water cooling means available at present a specific influencing of the cooling action is hardly possible. Finally, due not least to the cooling water processing involved the use of cooling water is always far more complicated economically than the fundamentally likewise possible simple cooling with ambient air and consequently the aim is to use only air for cooling as many extrusion press profile sections as possible, including for example lightweight metal extruded sections with small wall thickness.

From U.S. Pat. No. 4,790,167 an apparatus is known for cooling extruded forms in which outside the extrusion path of the forms a compressed air distributor is arranged having an elongated nozzle arranged along the extrusion path and comprising a slit-like nozzle opening. For adaptation to different profile forms the use of a plurality of air nozzles arranged along the extrusion path below the conveying plane is proposed. The compressed air is directed from below through individual air spraying nozzles onto the extruded articles. After leaving the extrusion apparatus the extruded sections are cut into lengths and thereafter conveyed on transport means running in the exit direction with their longitudinal axes parallel to the longitudinal axis of the upper slit nozzle beneath said slit nozzle. With this known type of cooling, the extruded articles are subjected to cooling air from above uniformly only if their profile is not appreciably wider than the slit-like opening of the upper nozzle. Even then, adequate cooling is ensured only if the extruded articles are each held for a certain time beneath the upper nozzle. For this reason and because of the individual spray nozzles arranged beneath the transport plane, neither adequate nor uniform cooling air action on a continuously transported extruded profile section is possible.

However, the conventional air cooling apparatuses cannot achieve the high cooling rates necessary for metallurgical reasons and are suitable only for cooling the extruded profile sections to a temperature permitting the handling necessary for the further production sequence, that is cutting, straightening, packaging, etc.

For these reasons, in the production of extruded profile sections there is simply a choice between two unsatisfactory alternatives, that is a metallurgically adequate cooling with water, leading however to a high distortion of the extruded profile sections in conjunction with high subsequent straightening and cooling water expenditure or the simple cooling with ambient air, which however provides only relatively low cooling rates and thus does not meet the metallurgical requirements.

The invention is therefore based on the problem of providing an apparatus for cooling extrusion press profile sections comprising nozzles of the type indicated in which the above-mentioned disadvantages do not occur.

In particular, an apparatus is to be proposed which firstly achieves the high cooling rates necessary for metallurgical reasons and secondly reliably avoids any distortion of the extruded profile sections during the cooling operation. The cooling effect is to be adjustable and thus adaptable to the particular requirements of the extruded profile sections to be cooled.

The advantages achieved with the invention are due firstly to the use of ambient air available in practically unlimited amounts as cooling medium, thus avoiding any problems involved in the processing of cooling water. By a particularly expedient configuration of the nozzles it is ensured that in spite of the cooling medium "ambient air", which has a lower heat dissipation capability than cooling water, the cooling rates necessary for metallurgical reasons are achieved. The cooling rate can be exactly set locally and thereby adapted to different extruded profile sections. Finally, for special cases a combination with water cooling is also possible.

Figure 2:
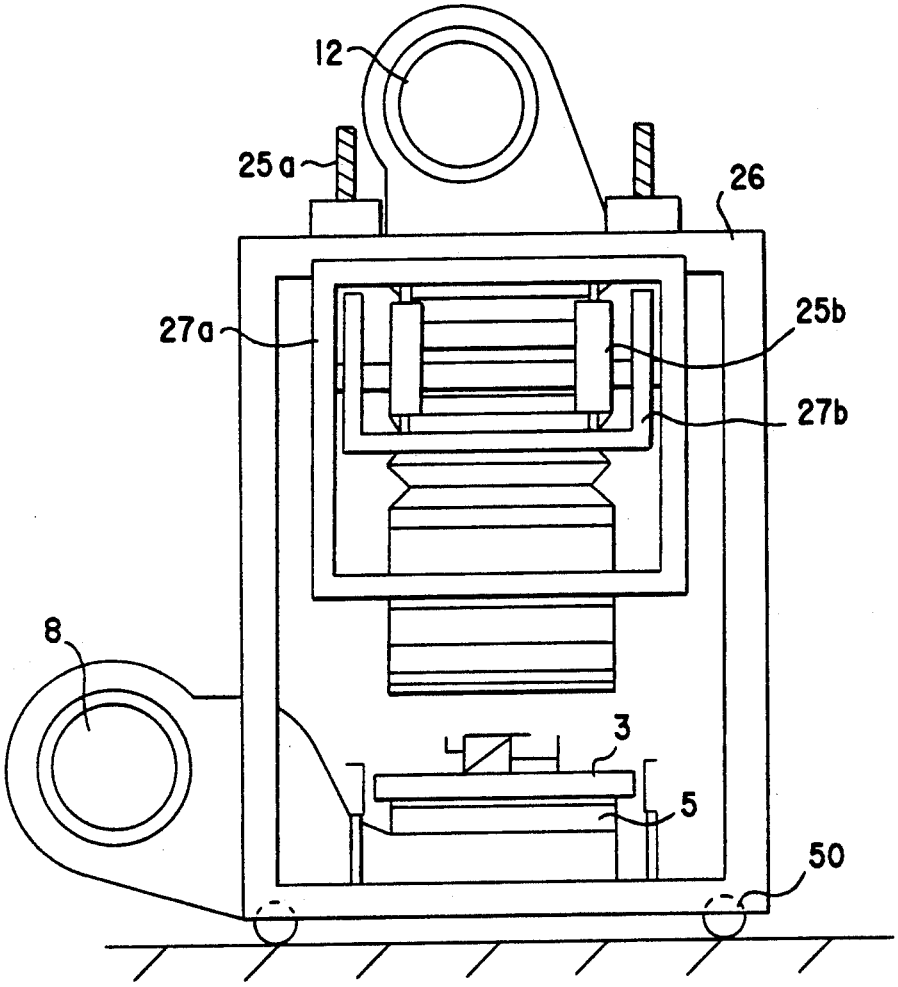
Figure 3:
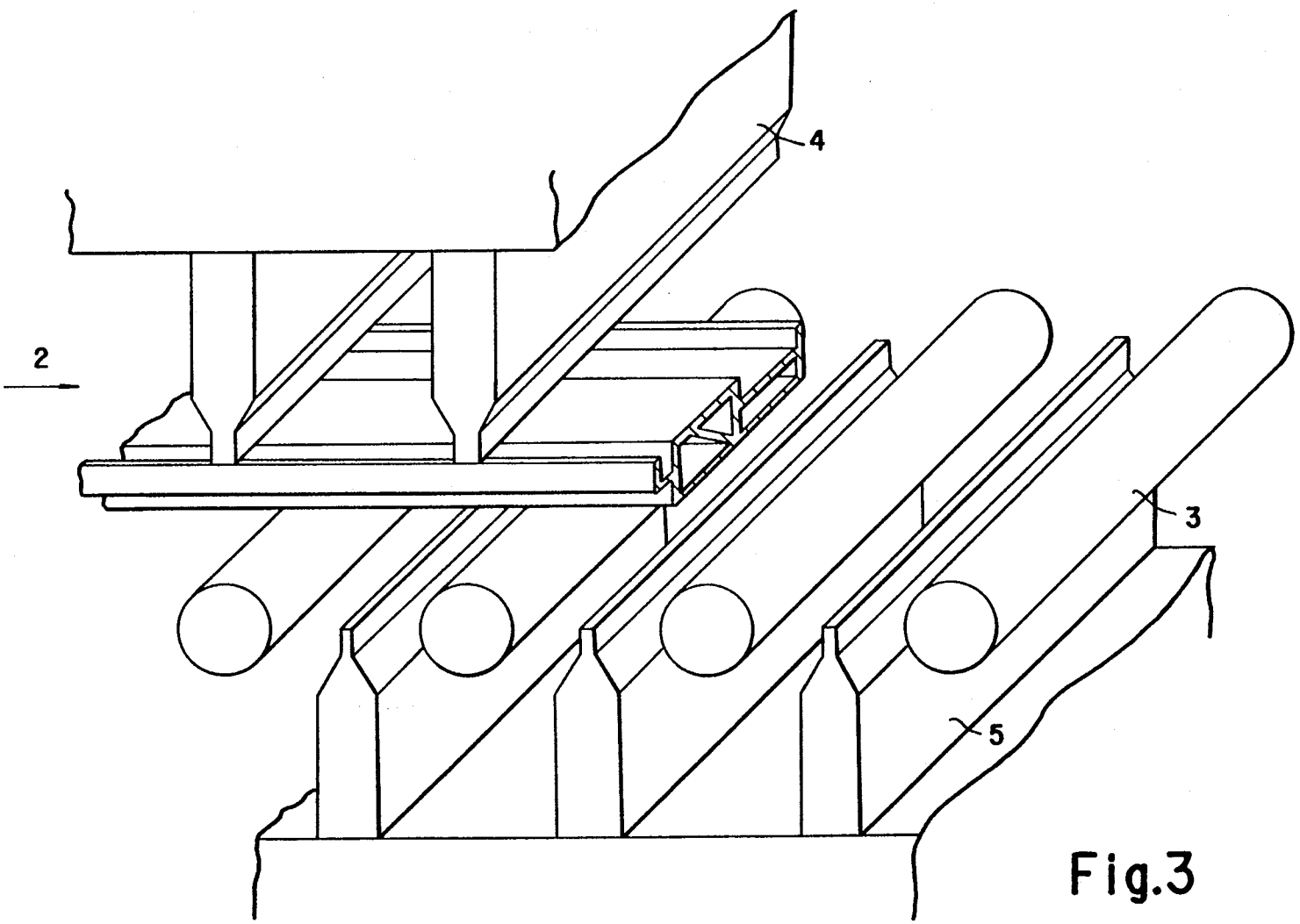
Figure 4:
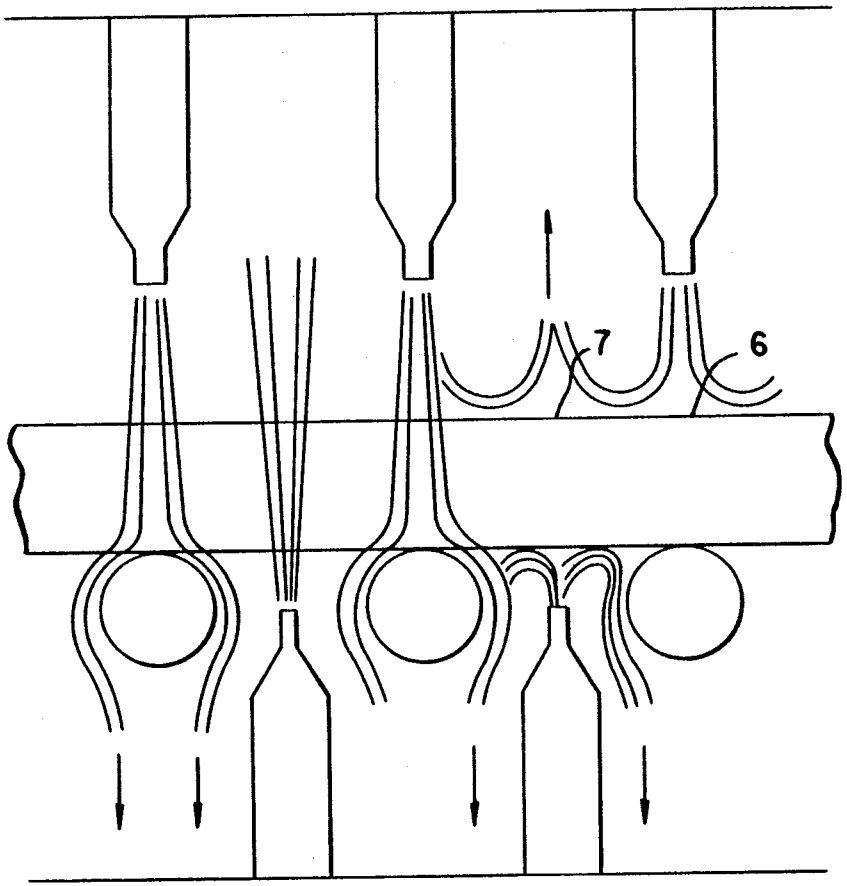
Figure 6:
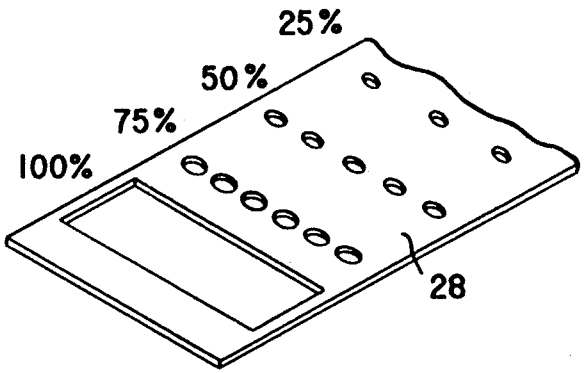
Figure 5:
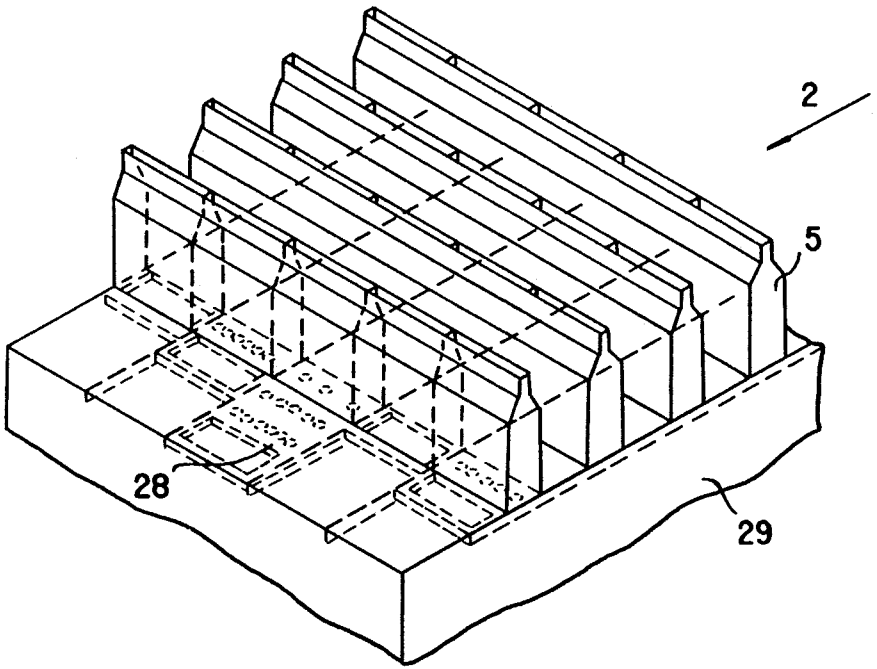
Figure 7:
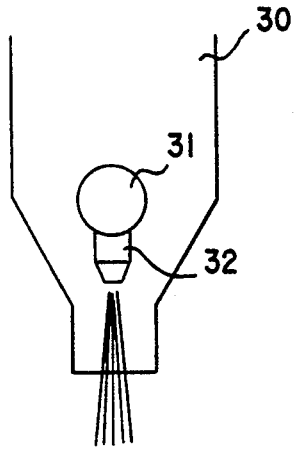
Figure 8:
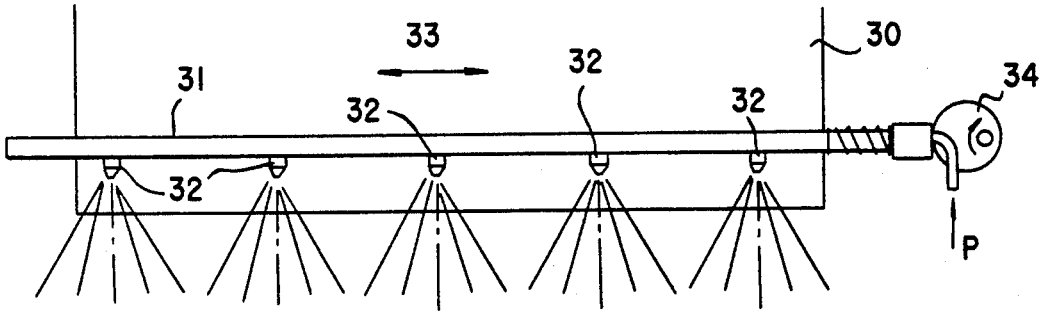
Figure 9:
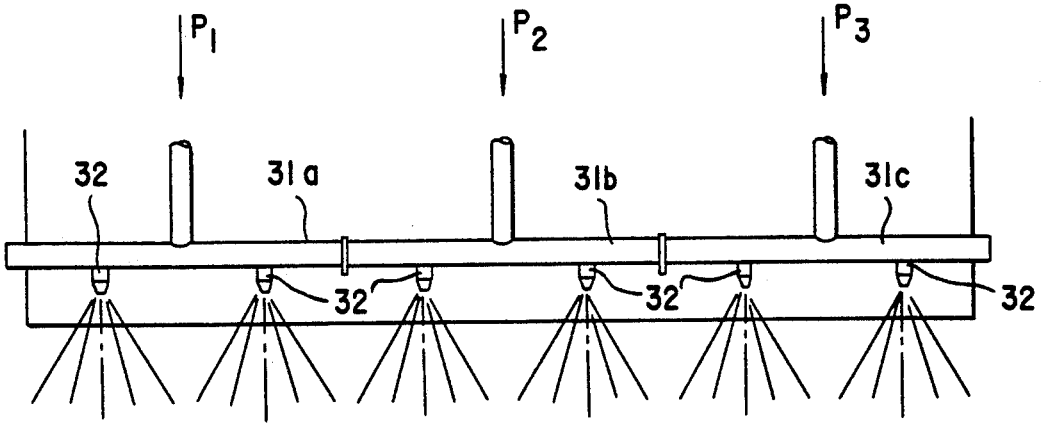
Figure 10:
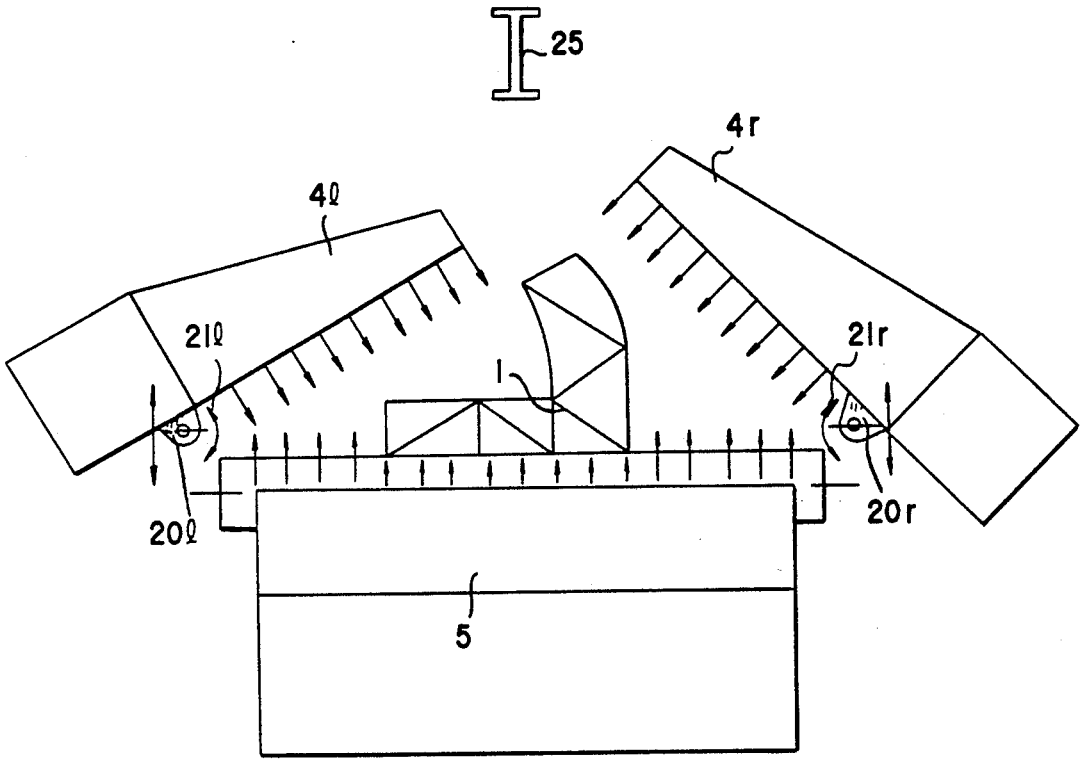

The invention will be described in more detail hereinafter with reference to examples of embodiment with the aid of the accompanying schematic drawings, wherein:

FIG. 1 shows a simplified illustration of a first embodiment of an apparatus for cooling extruded profile sections, FIG. 2 shows a view of said apparatus turned through 90° with respect to the illustration of FIG. 1, FIG. 3 is a perspective schematic illustration of the roller group with an extruded profile section and with the upper and lower slit nozzle systems, FIG. 4 shows a highly simplified view of the extruded profile section which is guided over rollers and the action of the cooling air thereon is illustrated by indicating the flow direction, FIG. 5 is a perspective illustration of four nozzles of the lower nozzle system from which the division into sections over the nozzle width is apparent, FIG. 6 is a perspective view of a slide integrated into the nozzle system for varying the heat transfer, FIG. 7 is an illustration of an air nozzle into which a nozzle holder having water spray nozzles is integrated, FIG. 8 shows a view of the air nozzle according to FIG. 7 rotated through 90° compared with FIG. 7, FIG. 9 shows a view corresponding to FIG. 8 with the division of the nozzle holder into three sections which can be supplied with different water pressure, and FIG. 10 shows a greatly simplified view of a further embodiment of an apparatus for cooling extruded profile sections in which the upper nozzle field is divided into two regions which can be upwardly pivoted about laterally disposed pivot pins.

The apparatus shown by the Figures and denoted generally by the reference numeral 10 for cooling extruded profile sections comprises a transport means for the extruded profile sections 1, that is a roller group 3 for conveying the extruded profile sections 1 in the direction of the arrow 2 through the apparatus 10.

Between the rollers of the roller group 3 lower nozzles 5 are disposed which blow onto the extruded profile section 1 from below. In the examples of embodiment illustrated the lower nozzles 5 are made stationary but can if necessary also be mounted movably in the vertical direction.

Arranged above the roller group 3 are upper nozzles 4 at a distance above the roller group 3 such that even the highest profile sections can pass through the vertical clearance between the roller group 3 and nozzles 4. As apparent in particular from FIGS. 3 and 4, the upper nozzles 4 are offset with respect to the lower nozzles 5 by half a pitch or division of the roller group 3 so that the air flows blown by the nozzles 3 and 4 onto the extruded profile section 1 do not mutually interfere with each other but can flow upwardly and downwardly substantially without any interference, as is shown in FIG. 4 by indicating the flow direction. A roller of the roller group 3 lies opposite a respective upper nozzle 4 whilst each lower nozzle blows into the intermediate space between two upper nozzles.

On the left side of FIG. 4 in three examples the tangential overflowing of the section sides is indicated whilst on the right side of FIG. 4 the impact flow is shown which impinges onto the extruded profile section 1 and is thereby deflected.

It can be seen that the blowing air from the upper nozzles 4 passes closely over the rollers of the roller group 3 and then flows away downwardly whilst the blowing air from the lower nozzles 5 flows away undisturbed upwardly into the intermediate space between the upper nozzles 4.

On striking the extruded profile section a deflection of the flow direction through 180° takes place as indicated by the arrows.

To enable the extruded profile section 1 to be observed during the extrusion operation or to permit possible deformation, the distance of the upper nozzles 4 from the roller group 3 or from the extruded profile sections 1 is greater than the distance of the lower nozzles 5 from the extruded profile section 1; to compensate the reduced cooling effect resulting from such a larger distance, the nozzle slits of the upper nozzles 4 are made wider than the nozzle slits of the lower nozzles 5 so that in spite of the greater distance of the upper nozzles 4 from the extruded profile sections 1 the core stream of the jets of the upper nozzles 4 still impinges fully onto the extruded profile section 1; as a result, with the same nozzle pressure for the upper and lower nozzles 4, 5 the arrival velocity of the flow at the surface of the extruded profile sections 1 can be kept substantially equal for the upper and lower nozzles 4, 5 and this is of significance for obtaining substantially the same heat transfer with the upper and lower nozzles 4, 5.

As apparent from FIG. 3, the slit nozzles of the upper and lower nozzle ribs 4, 5 are arranged transversely of the pressing and transport direction of the extruded profile sections 1 as indicated by the arrow 2. This achieves that the entire periphery of the extruded profile section 1 is always uniformly blasted and the flow from the region 6 where it strikes the surface of the extruded profile section 1 (see FIG. 4) always flows away in the direction of the generatrix of the profile section 1. In the axial direction the region 6 lies on the profile surface below the nozzle openings for the upper nozzles 4 and above the nozzle openings for the lower nozzles 5.

The extruded profile section 1 is thus moved through the static zone 7 (see FIG. 4) forming between every two adjacent slit nozzles of the nozzle ribs 4, 5. When the time required by the extruded profile section 1 to pass through half the pitch of the nozzles 4, 5 is short enough, which is always the case with a nozzle pitch of the order of magnitude of about 100 mm to 200 mm and the usual extrusion rates, the reduction of the heat transfer in the static zone 7 has no effect, i.e. the profile section is uniformly and continuously cooled as absolutely essential for metallurgical regions.

If the slit nozzles were replaced by round nozzles, which admittedly for the same expenditure of fan drive power provide a higher heat transfer, a static zone could form between two adjacent round nozzles and lead to a lower heat transfer always taking place in the region of a generatrix of the profile contour than in the adjacent region in the profile surface. As a result, in this deprived region the cooling would be weaker and the metallurgical properties in said region would be unfavourable.

In the cooling apparatus 10 illustrated in FIGS. 1 to 4 the upper nozzle field is divided into two equisized subfields which are each supplied by a double-flow radial fan 12 arranged above the nozzle field and blowing downwardly. The two upper nozzle boxes of the two subfields may be adjusted separately or jointly in the vertical direction in the direction of the double arrows 9. For this purpose the nozzle boxes are connected to the radial fans 12 via bellows 11 which permit the necessary distance variation between the nozzle boxes and radial fan 12. The common vertical adjustment means for adaptation to extruded profile sections of different height is indicated by four lifting spindles **25*a* which bear on the one hand on the frame 26 of the apparatus 10 and on the other hand are connected to a vertically movable frame 27*a* which in turn carries the bellows 11 and the nozzle boxes. By vertical adjustment of the lifting spindles 25*a* the bellows 11 and the nozzle boxes can thus also be adjusted vertically with respect to the roller group 3**.

In addition the lifting spindles **25*a* pneumatic cylinders 25*b*** may also be provided which generate the separate movement for initiating the rapid raising for the two nozzle boxes superimposed on the common raising and are actuated by switching means, such as contact switches or light barriers.

In the example of embodiment illustrated the two bellows 11 and thus the associated subfields are adjusted jointly by means of the frame **27*a***.

For rapid raising the pneumatic cylinders **25*b* mounted on the frame 27*a* actuate the carriages 27*b*** by means of which the nozzle boxes are moved for example via chains or cables.

The entire apparatus 10 is located in the frame 26 which can be moved into and out of the press line by means of wheels 50 and a conventional travelling drive transversely of the pressing direction (see FIG. 2). In this manner a simple substitution of the cooling apparatus 10 by another embodiment is possible if it becomes necessary for production technical reasons.

As apparent from FIG. 2, the lower nozzles 5 are supplied by a radial fan 8 which is arranged laterally adjacent the lower nozzle ribs 5 or the roller group 3 outside the frame 26. Here, fundamentally no division into a plurality of subfields is necessary; however, this can be additionally provided.

In FIG. 5 with the aid of an example of a fragment of a nozzle field it is shown how the transfer of heat of said nozzle field can be varied transversely of the movement direction 2 of the extruded profile section 1 and thus over the profile width. The nozzle field is divided uniformly into 5 subsections across the width. The cooling air supply to each subsection can be adjusted by means of nozzle slides 28 which are displaceable in the longitudinal direction, i.e. parallel to the movement arrow 2, and which are integrated into the nozzle boxes 29 of the lower nozzle ribs 5 illustrated.

FIG. 6 shows such a nozzle slide 28 with which the heat transfer can be adjusted in stages from 100% to 25% depending upon the region pushed in front of the nozzle inlet. These slides 28 adjustable by remote control, the position of which can additionally be controlled via a computer, permit adaptation of the cooling effect in accordance with the requirements of the extruded profile section 1. In this manner, regions of the extruded profile section 1 having material accumulations may for example be more highly cooled than regions of the extruded section 1 of smaller wall thickness. This ensures that the extruded section 1 during the cooling remains straight and avoids any bending of the section during cooling, which would lead to a high expenditure on subsequent straightening and moreover to considerable waste.

As apparent in FIG. 6, in the nozzle slide 28 openings of different area are provide, that is a large opening extending almost over the entire width of the nozzle slide 28 and permitting a maximum cooling air passage and thus a heat transfer of 100%, and three further rows of openings each of smaller diameter permitting the indicated heat transfers of 75%, 50% and 25%, in each case with respect to the maximum heat transfer of 100%.

In FIG. 7 a slit nozzle 30 is schematically illustrated, into which a nozzle holder 31 having water nozzles 52 is incorporated. In this manner the cooling apparatus according to FIGS. 1 to 4 can also be provided with a two-phase cooling, that is an air-water mixed cooling.

To compensate the disadvantage of the water nozzles 32 configured substantially as pinhole nozzles as regards the uniformity of the action on the section surface, the water nozzle holders 31 may be moved to and fro in the air nozzles 30 as indicated in FIG. 8 by the double arrow. For this purpose the water nozzles 32 are mounted on a tube forming the water nozzle holder 31 which on the one hand is traversed by water with the water pressure P and on the other is moved to and fro in the direction of the double arrow 33 by an electric motor with a camshaft 34. The amplitude of the reciprocal motion corresponds substantially to a multiple of half the pitch of the water nozzles in the direction transversely of the pressing and exit direction 2 of the profile section 1.

To enable the cooling action to be varied across the profile width in a manner similar to that of a pure air cooling, in the embodiment according to FIG. 9 the water nozzle holder 31 formed by a tube with nozzles 32 is divided into a plurality of regions 31*a*, 31*b* and 31*c* which are subjected to different water pressures $P_1$, $P_2$ and $P_3$. As a result the water impingement density beneath the nozzles 32 varies in the respective regions.

Since in such a two-phase cooling the influence of the air cooling is relatively small compared with the water cooling, i.e. with such a two-phase cooling the heat transfer coefficient depends substantially only on the water spraying density, in this case variation of the air cooling action over the profile width may be dispensed with. It is however also possible to combine the two methods.

Finally, FIG. 10 shows a highly schematic view of a cooling apparatus 10 seen in the pressing direction in which the extruded profile section 1 is blasted by the lower nozzle field 5 and two upper nozzle fields 4*r* and 4*l*, that is a right subfield 4*r* and a left subfield 4*l*. These subfields may be pivoted about associated axes 20*r* and 20*l* as indicated by the associated rotation arrows 21*r* and 21*l*.

As a result, in particularly simple and thus favourable manner the cooling action can be adapted also to angular profile cross-sections as indicated in the example of FIG. 10.

Furthermore, there is now a free space between the two upper nozzle subfields 4*r*, 4*l* for the access of a puller which is indicated in FIG. 10 by a double T-profile 25 on which such a puller is guided.

For the adaptation the pivot pins 20*l* and 20*r* can be pivoted about the nozzle fields 4*l*, 4*r* and also vertically adjusted. The air supply to the nozzle boxes of the two subfields 4*l*, 4*r* is by means of flexible connections or conduits.

We claim:

1. An apparatus for cooling an extruded member comprising:

a plurality of rollers for transporting the extruded member through said apparatus, said rollers defining a path for transporting the extruded member in a transport direction;

a plurality of upper air nozzles for impinging cooling air on the extruded member from above the path of the extruded member, said upper air nozzles having a slit-shaped opening extending in a direction transverse to the transport direction of the extruded member, said slit-shaped opening having a first slit width, said upper air nozzles being disposed a first distance from the path of the extruded member;

a plurality of lower air nozzles for impinging cooling air on the extruded member from below the path of the extruded member, said lower air nozzles having a slit-shaped opening extending in a direction transverse to the transport direction of the extruded member, said slit-shaped opening of said lower air nozzles having a second slit width, said second slit width being narrower than said first slit width, said lower air nozzles being disposed a second distance from the path of the extruded member, said second distance being shorter than said first distance, said lower air nozzles further being offset with respect to said upper air nozzles by approximately one-half of a pitch between said rollers measured in the transport direction;

a source of cooling air connected to said upper air nozzles; and a source of cooling air connected to said lower air nozzles.

2. The apparatus of claim 1, wherein said upper air nozzles and said lower air nozzles are disposed on nozzle boxes.

3. The apparatus of claim 2, wherein said slit-shaped openings in said upper air nozzles and said lower air nozzles are divided into at least two sections and said nozzle boxes include means for varying nozzle pressure in the at least two sections of said slit-shaped openings.

4. The apparatus of claim 3, wherein said means for varying nozzle pressure in the at least two sections of said slit-shaped openings comprises slide plates having at least one aperture therein, said slide plates being slidably mounted in said nozzle boxes.

5. The apparatus of claim 2, wherein said upper air nozzles are disposed on first and second nozzle boxes.

6. The apparatus of claim 5, wherein said source of cooling air connected to said upper air nozzles comprises first and second radial fans, said first nozzle box being connected to said first radial fan and said second nozzle box being connected to said second radial fan.

7. The apparatus of claim 6, wherein said first and second nozzle boxes are vertically adjustable.

8. The apparatus of claim 5, wherein said first and second nozzle boxes are pivotably mounted for cooling an extruded member having an angular profile.

9. The apparatus of claim 8, wherein said first and second nozzle boxes are pivotably mounted on pins, said pins being disposed proximate to respective ends of said rollers and extending in the transport direction of the extruded member.

10. The apparatus of claim 1, wherein said upper air nozzles are disposed opposite to said rollers and said lower air nozzles are disposed in between said rollers.

11. The apparatus of claim 1, wherein said upper air nozzles are vertically adjustable.

12. The apparatus of claim 1, wherein a plurality of water nozzles are disposed in one of said upper air nozzles and said lower air nozzles.

13. The apparatus of claim 12, wherein said water nozzles are mounted on a tube for supplying water to said water nozzles, said tube reciprocating within one of said upper air nozzles and said lower air nozzles in a direction transverse to the transport direction of the extruded member.

14. The apparatus of claim 13, wherein said tube is divided into at least two sections for receiving water having different water pressures.

* * * * *